US007121627B2

(12) United States Patent
Gaikwad et al.

(10) Patent No.: US 7,121,627 B2
(45) Date of Patent: Oct. 17, 2006

(54) LEG-REST EXTENSION

(75) Inventors: Pawan Gaikwad, Miami, FL (US); Pedro Meneses, Miami, FL (US)

(73) Assignee: B/E Aerospace, Inc., Wellington, FL (US)

( * ) Notice: Subject to any disclaimer, the term of this patent is extended or adjusted under 35 U.S.C. 154(b) by 50 days.

(21) Appl. No.: 10/961,877

(22) Filed: Oct. 8, 2004

(65) Prior Publication Data

US 2006/0076807 A1 Apr. 13, 2006

(51) Int. Cl.
*A47C 7/36* (2006.01)

(52) U.S. Cl. ..... 297/423.36; 297/75; 297/423.28

(58) Field of Classification Search ..... 297/76, 297/423.19, 423.26, 423.29, 423.28, 423.36, 297/423.3
See application file for complete search history.

(56) References Cited

U.S. PATENT DOCUMENTS

| | | | | |
|---|---|---|---|---|
| 156,004 | A * | 10/1874 | Wayland | 297/423.3 |
| 945,928 | A * | 1/1910 | Fowler et al. | 297/70 |
| 1,553,689 | A * | 9/1925 | Hill | 297/90 |
| 4,336,965 | A * | 6/1982 | Lipp | 297/423.36 |
| 5,507,562 | A * | 4/1996 | Wieland | 297/423.2 |
| 5,560,681 | A | 10/1996 | Dixon et al. | |
| 6,030,033 | A * | 2/2000 | Schultz | 297/84 |
| 6,095,610 | A * | 8/2000 | Okajima et al. | 297/423.36 |
| 6,494,536 | B1 | 12/2002 | Plant | |
| 6,669,143 | B1 | 12/2003 | Johnson | |
| 6,692,069 | B1 | 2/2004 | Beroth et al. | |
| 6,692,078 | B1 * | 2/2004 | Pham et al. | 297/423.2 |
| 6,695,406 | B1 | 2/2004 | Plant | |
| 2002/0063449 | A1 * | 5/2002 | Plant | 297/68 |

OTHER PUBLICATIONS

U.S. Appl. No. 10/960,299, filed Oct. 8, 2004, Williamson et al.

* cited by examiner

*Primary Examiner*—Peter M. Cuomo
*Assistant Examiner*—Joseph Edell
(74) *Attorney, Agent, or Firm*—Gardner Carton & Douglas LLP

(57) ABSTRACT

A leg-rest assembly for use with a chair, in particular, a reclining chair is disclosed. The leg-rest assembly is comprised of a leg-rest pivotally connected to a seat, and a foot-rest portion attached in a telescopic relationship with the leg-rest portion.

19 Claims, 11 Drawing Sheets

LEG-REST EXTENSION

CROSS-REFERENCE TO RELATED PATENT APPLICATIONS

This patent application is related to U.S. patent application Ser. No. 10/960,299, filed Oct. 6, 2004, entitled Reclining Chair.

FIELD OF THE INVENTION

This invention pertains to furniture and, more particularly, to a foot rest for a reclining chair.

BACKGROUND OF THE INVENTION

Reclining chairs are well known in the art, as are chairs that have a foot rest that can extend from the seat portion in conjunction with or independent of the reclining of the back portion of the chair. Known recliners, however, have a gap between the seat portion of the chair and the leg-rest portion when the leg rest is fully extended. This can cause discomfort to some users who have to sit for long periods of time, such as during a transatlantic or transpacific airplane flight. Furthermore, most leg-rest portions do not extend far enough to accommodate the feet of tall occupants. This results in the occupant's feet hanging over the end of the leg rest, a position that can cause discomfort or circulation problems during long periods of sitting in general and sleeping, in particular.

Because many people must sit, and even sleep, for long hours in a chair on, for example, an international aircraft flight, a chair having a leg-rest assembly capable of extending from the seat without generating a gap between the seat and the leg rest, and to accommodate one's feet would be an important improvement in the art.

BRIEF SUMMARY OF THE INVENTION

The invention is directed to a leg-rest assembly for use with a chair, in particular, a reclining chair. The leg-rest assembly is comprised of a leg rest pivotally connected to a seat, and a foot-rest portion attached in a telescopic relationship with the leg-rest portion.

DETAILED DESCRIPTION OF THE INVENTION

Figure 1:
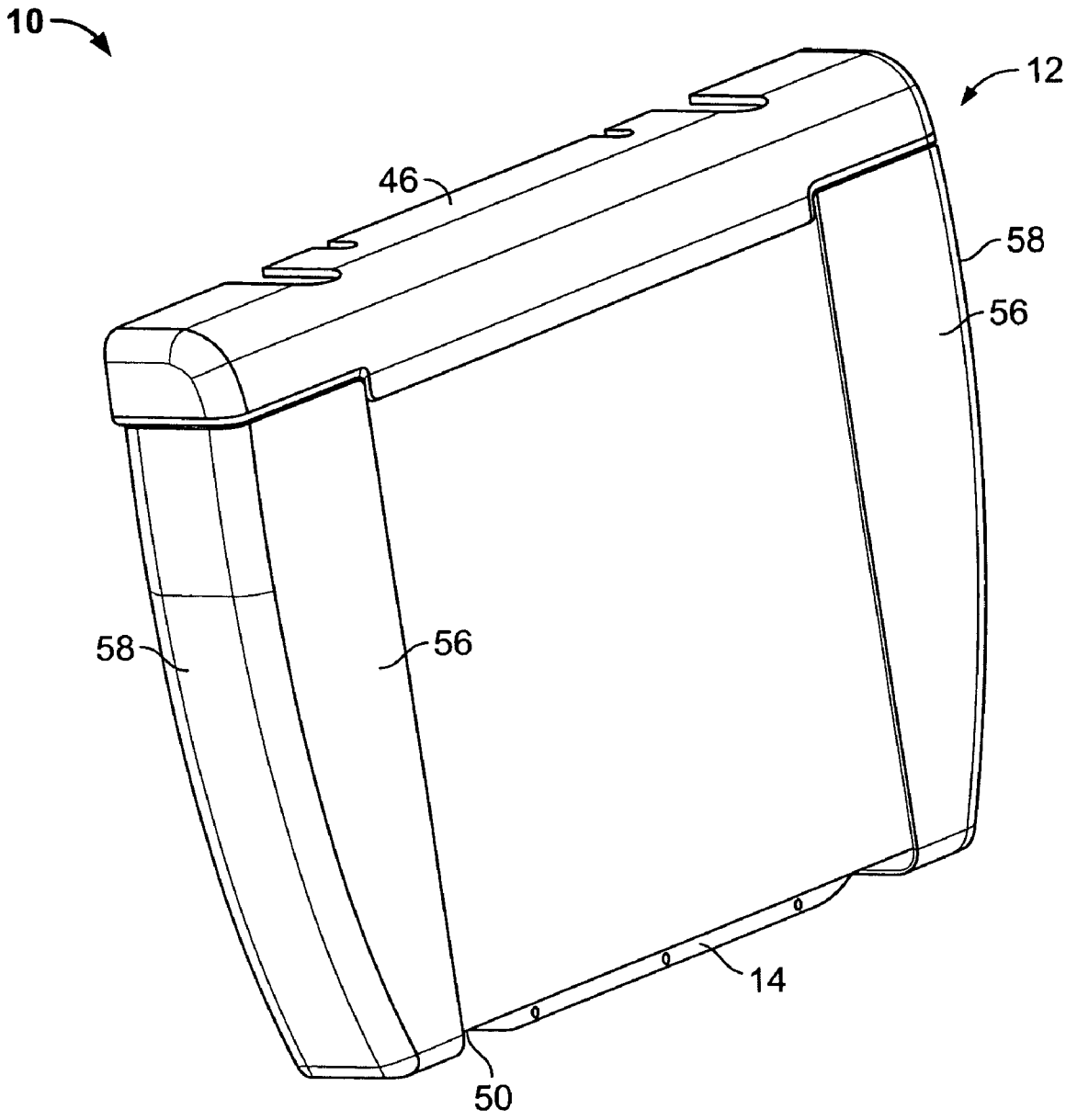
FIG. 1 is a perspective view of the front of the leg-rest assembly.

The invention, as shown in FIGS. 1–15 is direct to a leg-rest assembly 10 for use with a chair (not shown), in particular, a reclining chair. The leg-rest assembly 10 is comprised of a leg-rest portion 12 pivotally connected to a seat (not shown), and a foot-rest portion 14 attached in a telescopic relationship with the leg-rest portion 12.

As shown in FIGS. 2, 4–7, 11 and 13, at least two pulleys 16 are attached to the leg-rest portion 12. These two pulleys 16 are separated from each other and are connected by a cable 18 passing around each of the pulleys 16. In addition to passing around the pulleys 16, the cable 18 is fixed, in a suitable way such as with a mount 20, to the foot-rest portion 14, as shown in FIGS. 2, 4–7, 11, 13 and 14–15. At least one mounting bracket 22 is attached to the leg-rest portion 12. The at least one mounting bracket 22 has a first end 24 pivotally connected to the seat and a second end 26 attached to the cable 18 and slidably connected to the leg-rest portion 12. As shown in FIGS. 4–7, 13 and 15, the mounting bracket 22 can be attached to a guide track 28 attached to the leg-rest portion 12.

As used throughout this description, the phrase "around the pulleys" is meant to mean in contact with the pulley and includes the cable passing either over or under a pulley.

The leg-rest portion 12, as shown in FIGS. 5–10, may be pivotally connected at a first position 30 to a first and a second side rail 32, 34 of a seat pan 36 which is similar to the one disclosed in U.S. patent application Ser. No. 10/960,299, filed Oct. 6, 2004, entitled Reclining Chair, the content of which is incorporated herein by reference. The at least one mounting bracket 22 has a first end 24 pivotally connected at a second position 38 to the first and second side rails 32, 34 of the seat pan 36 and a second end 26 attached to the cable 18 and slidably connected to a side of the leg-rest portion 12.

In one embodiment of the invention, as shown in FIGS. 2, 4–6 and 11, a first and second set of pulleys 42, 44, each set having two pulleys 16, 17, are attached to the leg-rest portion 12. A first cable 18 extends around and connects the two pulleys 16 of the first set 42 while a second cable 19 extends around and connects the two pulleys 17 of the second set 44. Each of the cables 18, 19 is also fixed to the foot-rest portion 14 of the leg-rest assembly 10. A first and second mounting bracket 22, 23, are each pivotally connected at a first end 24 to a second position 38 on the seat while also being connected at their second end 26 to the respective first and second cable 18, 19, as well as slidably connected to the leg-rest portion 12. In a particular version of the embodiment, the first end 24 of each of the first and second mounting brackets 22, 23 is pivotally connected at the second position 38 to the, respective first and second side rails 32, 34 of the seat pan 36.

Figure 2:
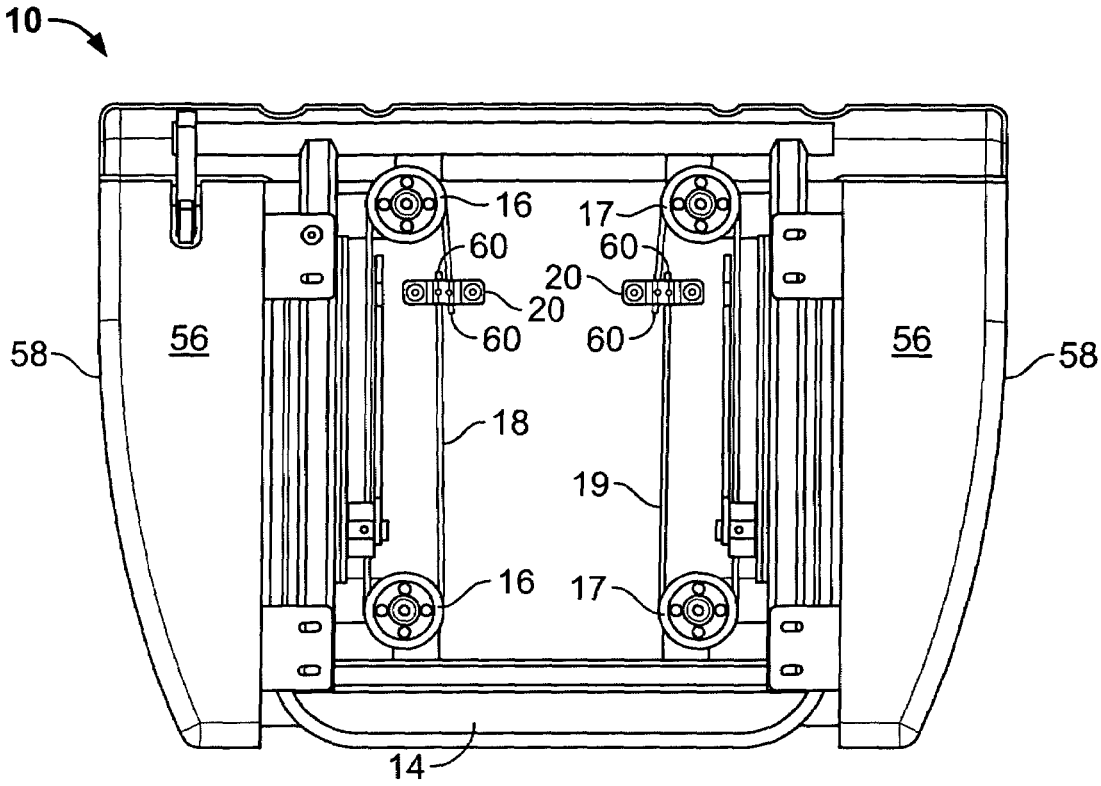
FIG. 2 is a view of the underside of the leg-rest assembly showing the cable and linkage system.
Figure 4:
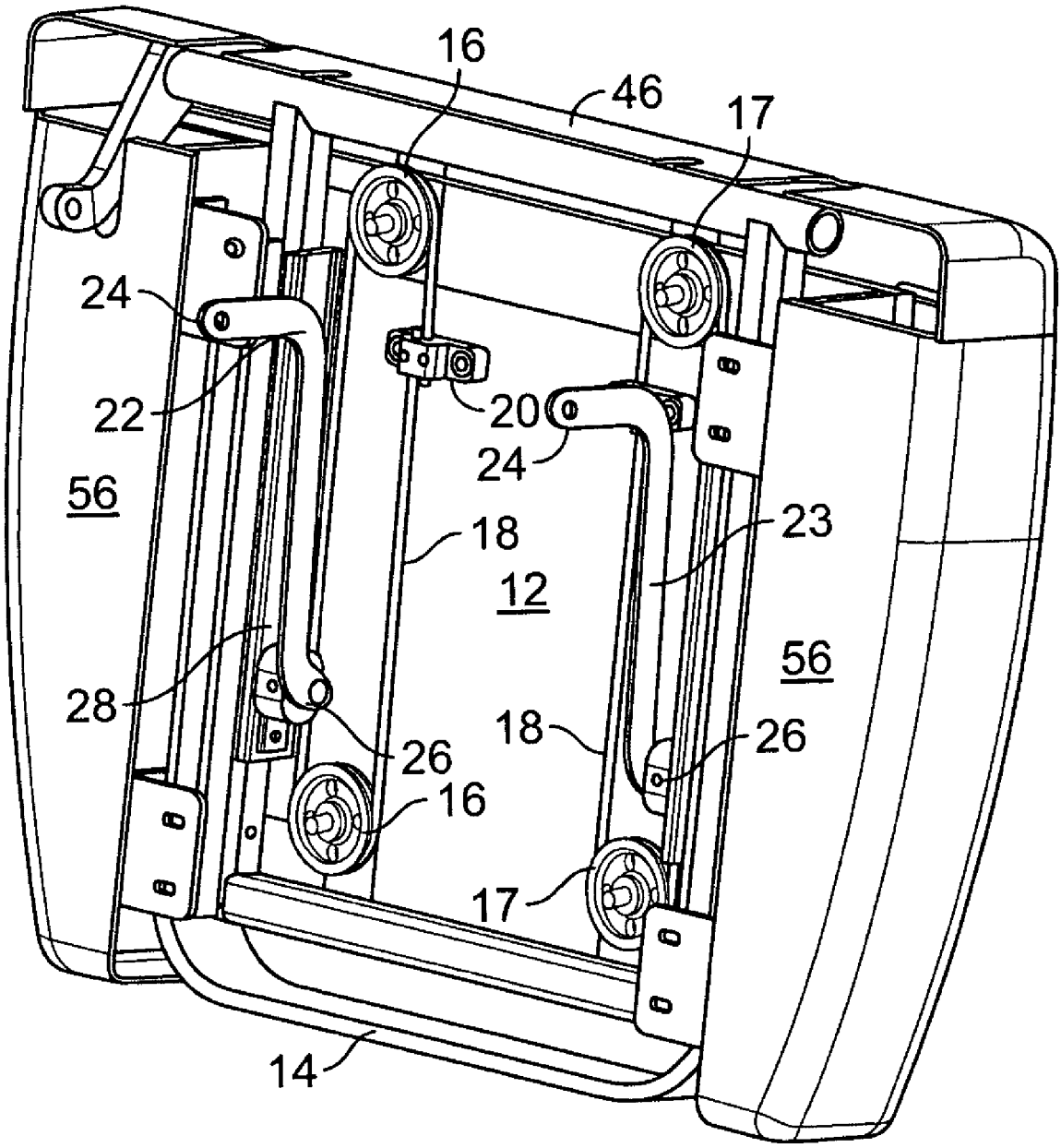
FIG. 4 is a perspective view of the underside of the leg-rest assembly.
Figure 11:
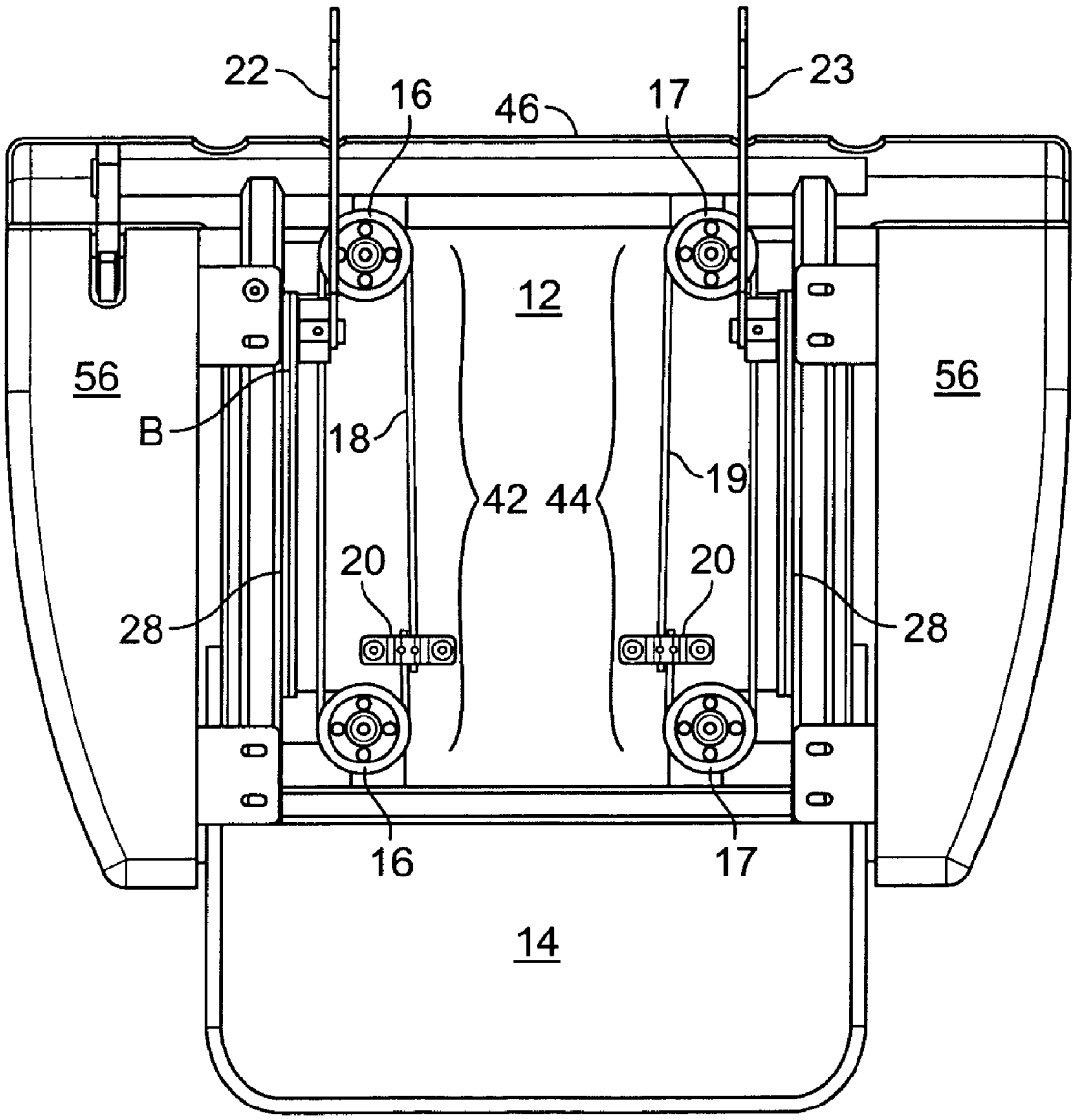
FIG. 11 is a view of the underside of the leg-rest assembly showing the side panels attached and the foot-rest portion in the extended position.
Figure 12:
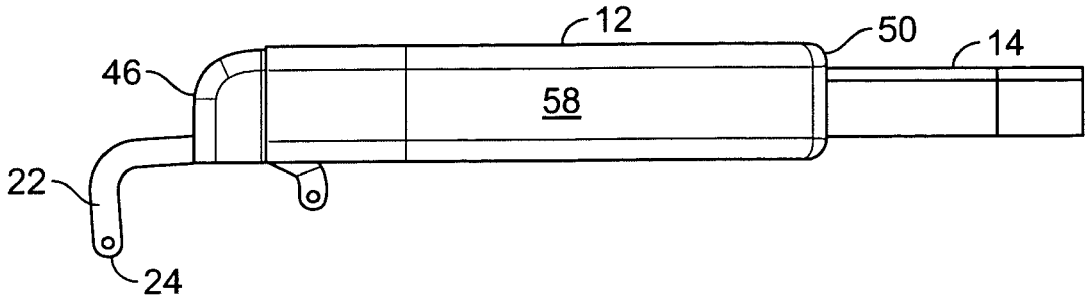
FIG. 12 is a side view of the leg-rest assembly showing the foot rest extended.

As shown in FIGS. 2, 4 and 11, the first cable 18 may be spaced apart from and substantially parallel to the second cable 19, and the first mounting bracket 22 may be spaced apart from and substantially parallel to the second mounting bracket 23.

In another embodiment, as shown in FIGS. 6–9, the leg-rest portion 12 has a first end 46 proximal to the seat, a mounting tube 48 is attached to the first end 46 of the leg-rest portion 12, and the mounting tube 48 is attached, at the first position 30, to the first and second side rail 32, 34 of the seat pan 36. This allows the leg-rest portion 12 to be extended without generating a gap between the seat cushion and the leg-rest portion 12.

Figure 6:
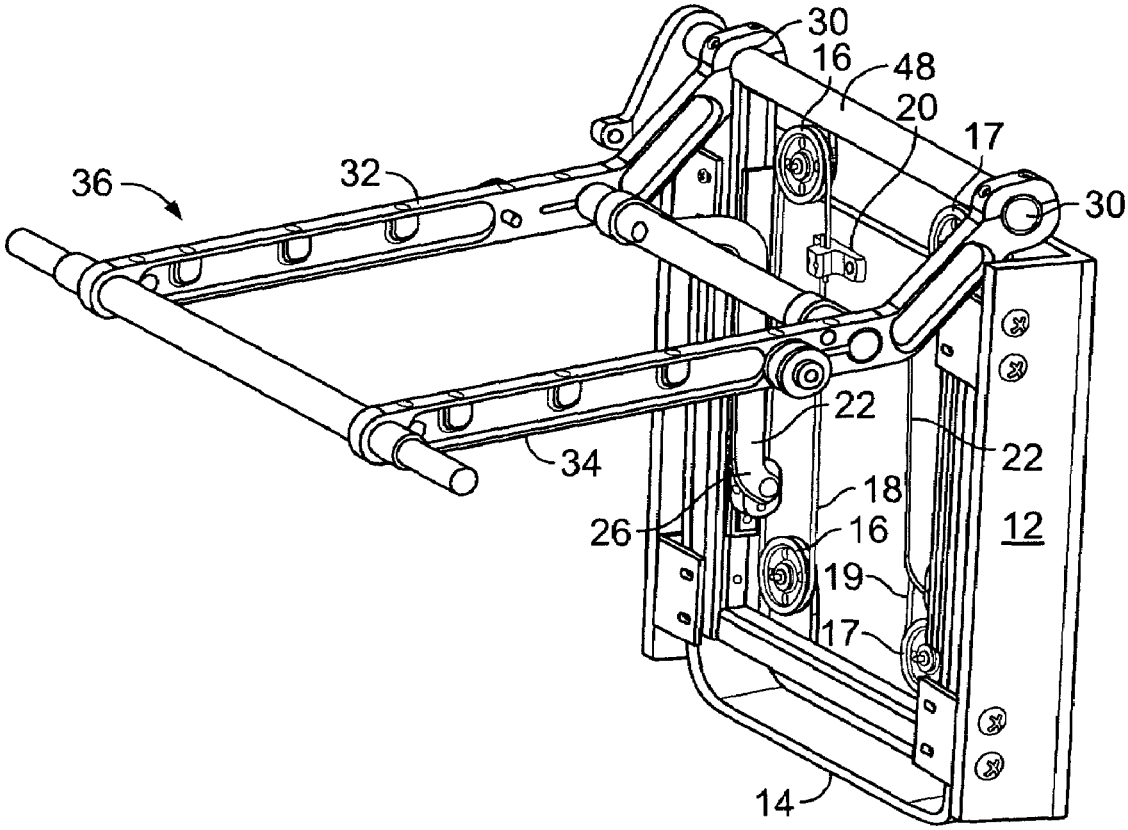
FIG. 6 is a perspective view showing the frame of the leg-rest assembly with the side panels removed attached to the side rails of a seat assembly
Figure 7:
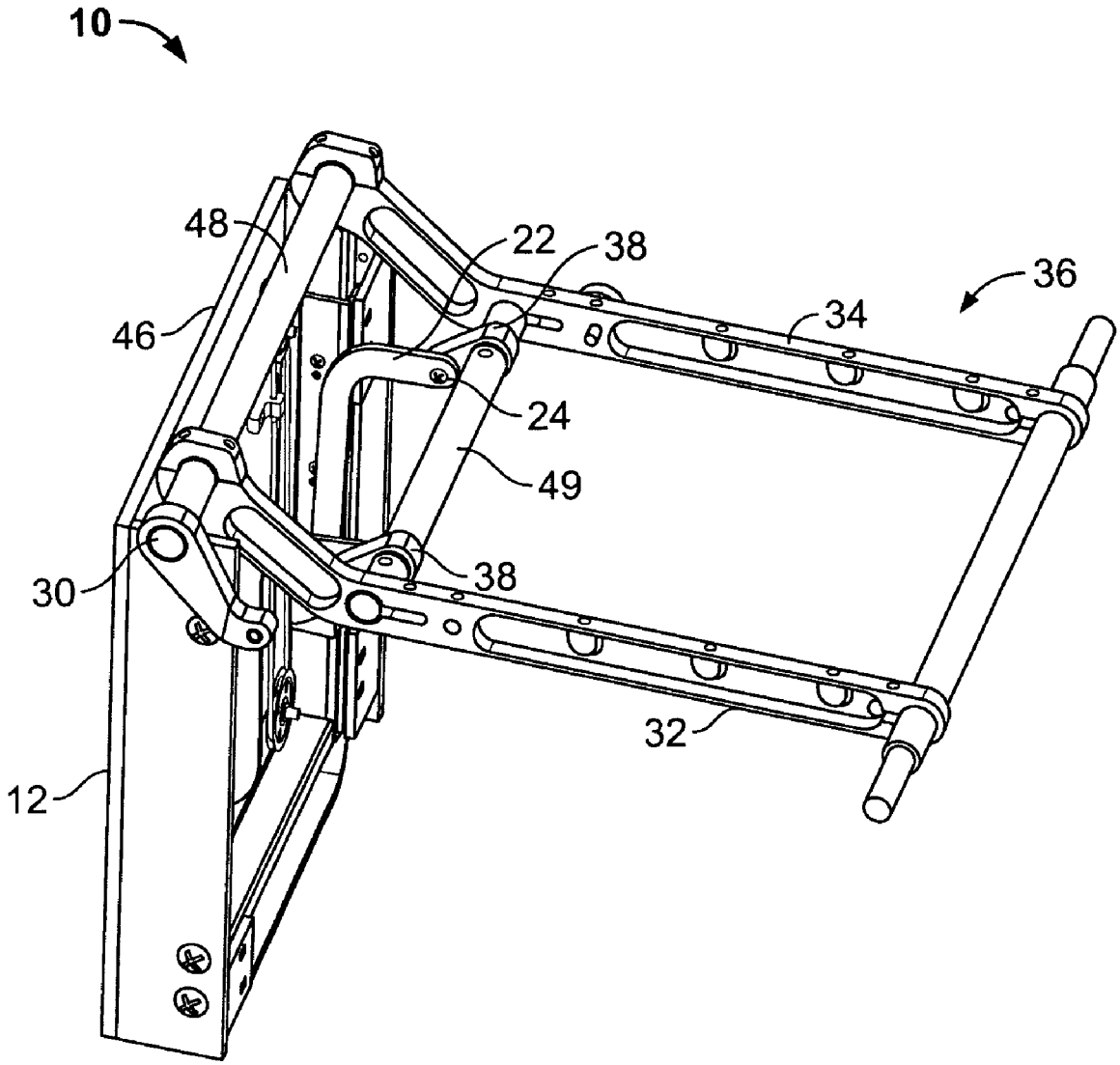
FIG. 7 is another perspective view of the frame of the leg-rest assembly.
Figure 8:
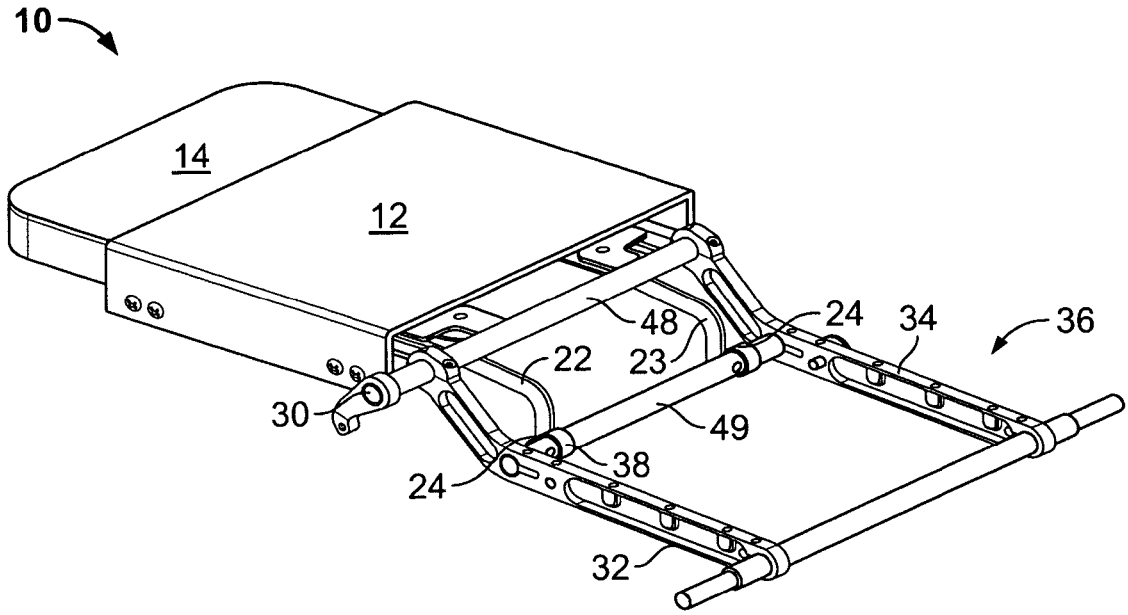
FIG. 8 is a perspective view of the leg-rest assembly, without the side panels, showing the leg-rest portion and the foot-rest portion in an extended position.
Figure 9:
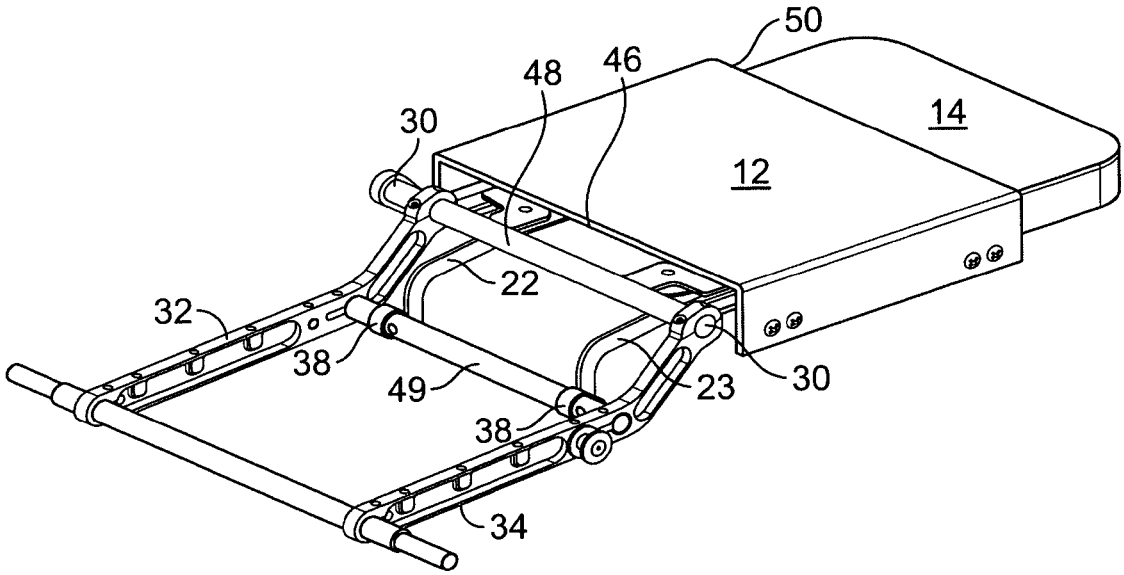
FIG. 9 is another perspective view of the leg-rest assembly, without the side panels, showing the leg-rest portion and the foot-rest portion in an extended position.
Figure 10:
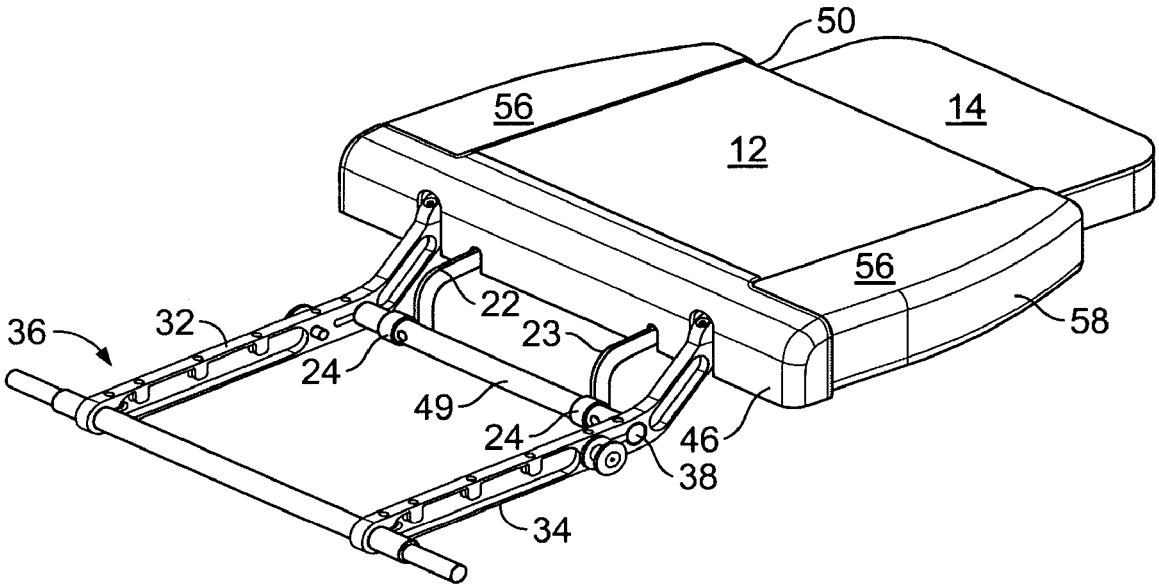
FIG. 10 is a perspective view of the leg-rest assembly, with side panels attached, showing the leg-rest portion and the foot extension portion in the extended position.

As shown in FIGS. 6, 8 and 9, the leg-rest portion 12 has a top end 46 and a bottom end 50 separated from and substantially parallel to each other. First and second sides 52, 54 are separated from each other and substantially perpendicular to the top and bottom ends 46, 50, and a side panel 56 is removably connected to each of the first and second sides 52, 54. The side panels 56 may have a curved edge 58 distal to the leg-rest portion 12 as shown in FIGS. 1, 2, 4 and 10–12.

Figure 5:
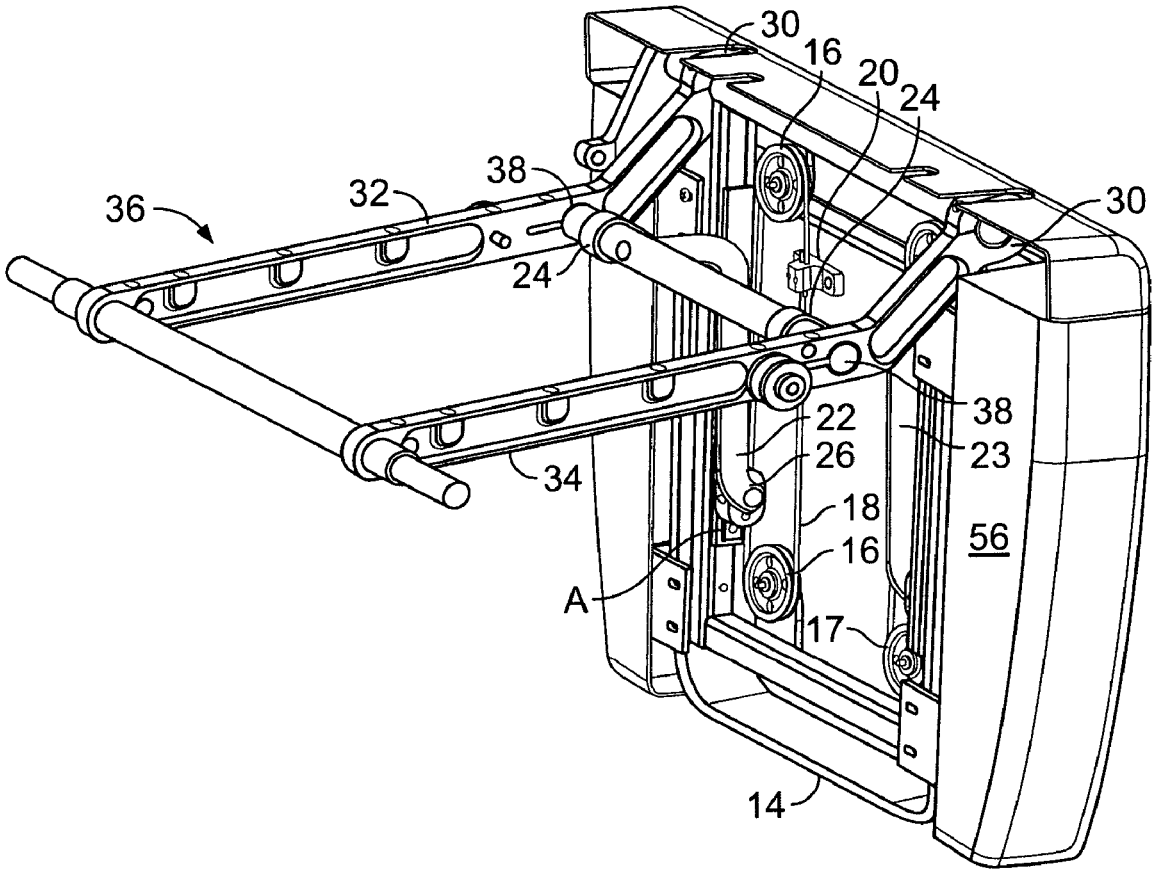
FIG. 5 is a perspective view showing the leg-rest assembly attached to the side rails of a seat assembly.
Figure 13:
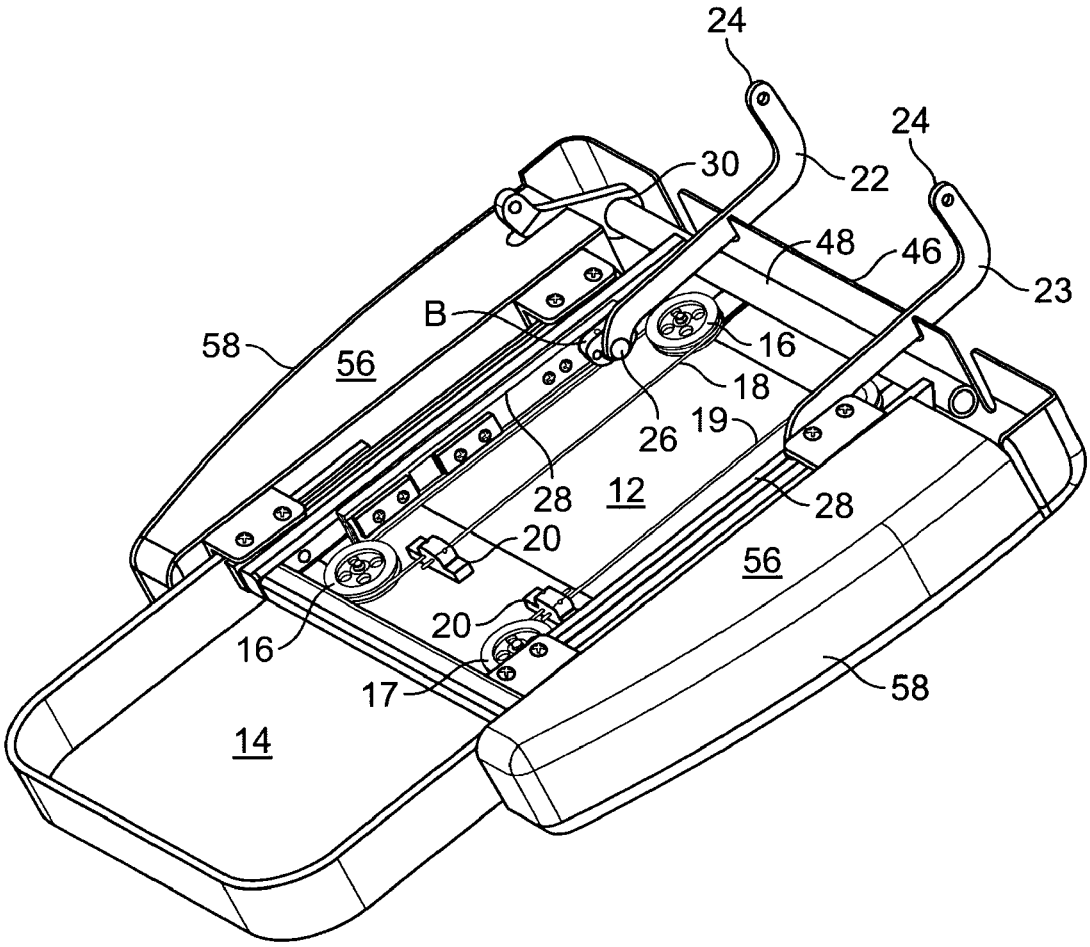
FIG. 13 is a perspective view of the underside of the leg-rest assembly showing the foot-rest portion extended.
Figure 14:
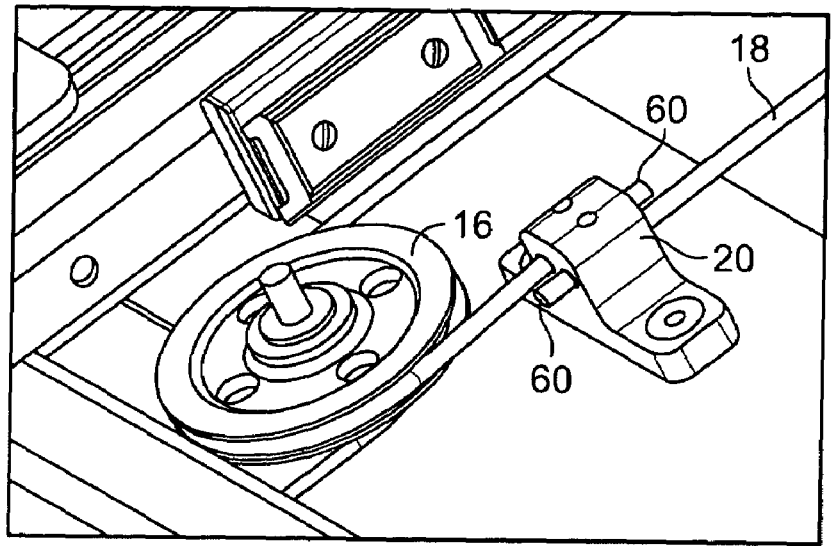
FIG. 14 is a close-up perspective view of a cable and pulley showing the cable fixed to the foot-rest portion.
Figure 15:
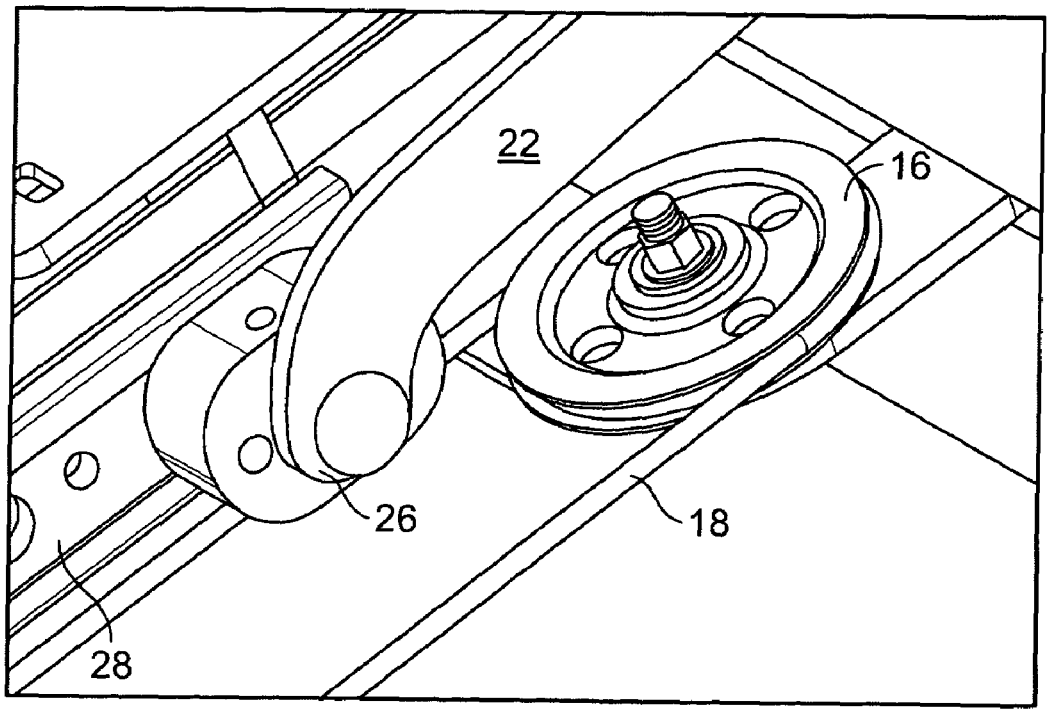
FIG. 15 is a close-up perspective view of a cable and pulley showing the mounting bracket attached to the cable and the leg-rest portion of the assembly.

When in operation, an occupant of the seat can extend the leg-rest portion 12 using any mechanical or electrical means known in the art. Furthermore, the leg-rest portion 12 may be extended in conjunction with, or independent of, the reclining of the back portion (not shown) of the chair. As the leg-rest portion 12 extends forward from the seat, the mounting bracket 22 pivots about its attachment point 38, which may be a second mounting tube 49, on the seat, thereby causing the second end 26 of the bracket 22 to move along the guide track 28 in the leg rest 12, as shown in FIGS. 5 and 13. Because the end 26 of the mounting bracket 22 that moves from a first position A (as shown in FIG. 5) on the leg-rest portion 12 distal to the top 46 of the leg rest 12 to a second position B (as shown in FIGS. 11 and 13) proximal to the top 46 is attached to the cable 18, it pulls the cable 18 around the pulleys 16, thereby pulling the fixed ends 60 of the cable 18, and the foot-rest portion 14 of the assembly 10, toward the bottom end 50 of the leg-rest portion 12, as shown in FIG. 13. This causes the foot-rest portion 14 to extend from the leg-rest portion 12.

Figure 3:
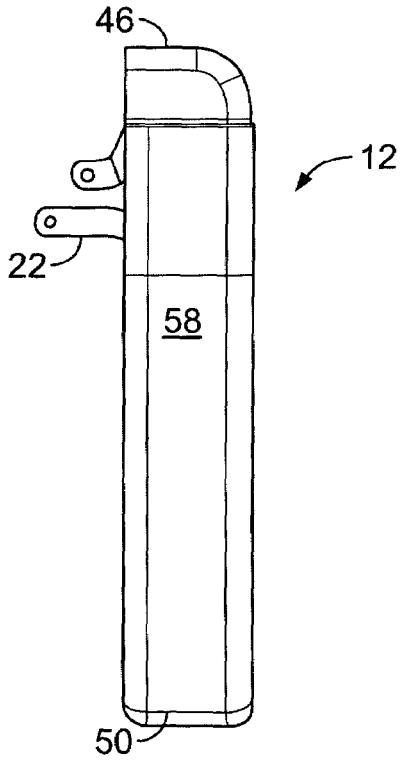
FIG. 3 is a side view of the leg-rest assembly.

When the leg-rest portion 12 is retracted, the mounting bracket 22 again pivots about its attachment point 38 on the seat, thereby causing the end 26 of the bracket 22 attached to the leg-rest portion 12 to move from the second position B proximal to the top 46 of the leg rest 12 to the first position A distal to the top 46, thereby pulling the cable 18 in the reverse direction and causing the foot-rest portion 14 to retract into the leg-rest portion 12. In an embodiment, when the leg-rest portion 12 is in a retracted position, the bottom end 50 is recessed with respect to the top end 46, as shown in FIG. 3, thereby creating more leg room between the chair and any object in front of the chair.

The invention also involves a method of reclining a chair comprising the steps of: (a) sitting in a chair having a reclinable back portion and a leg-rest portion attached to a seat portion; (b) reclining the back portion from a substantially vertical position to a substantially horizontal position; (c) raising the leg-rest portion from a substantially vertical position to a substantially horizontal position simultaneously with the recline of the back portion; and (d) extending a foot-rest portion from the leg-rest portion substantially simultaneously with the raising of the leg-rest portion.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A leg-rest assembly for use with a reclining chair, the leg-rest assembly comprised of:

a leg-rest portion;

a foot-rest portion attached in a telescopic relationship with the leg-rest portion;

a set of pulleys attached to the leg-rest portion, the set including two pulleys separated from each other;

a cable passing around the two pulleys and being fixed to the foot-rest portion; and a mounting bracket, the mounting bracket including a first end pivotally connected to a seat pan and a second end attached to the cable and slidably connected to the leg-rest portion.

2. The leg-rest assembly of claim 1, wherein the mounting bracket is positioned in a guide track attached to the leg-rest portion.

3. The leg-rest assembly of claim 1, wherein:

the leg-rest portion is pivotally connected at a first position to a first and second side rail of the seat pan;

the first end of the mounting bracket being pivotally connected at a second position to the first and second side rails of the seat pan and the second end of the mounting bracket being attached to the cable and slidably connected to a side of the leg-rest portion.

4. The leg-rest assembly of claim 3, wherein:

the leg-rest portion has a first end proximal to the seat pan;

a mounting tube is attached to the first end of the mounting bracket; and the mounting tube is attached, at the first position, to the first and second side rail of the seat pan.

5. The leg-rest assembly of claim 1 further comprising:

a second set of pulleys attached to the leg-rest portion, the second set including two pulleys separated from each other;

a second cable passing around the two pulleys of the second set and being fixed to the foot-rest portion; and a second mounting bracket, the second mounting bracket having a first end pivotally connected at the second position on the seat pan and a second end attached to the second cable and slidably connected to the leg-rest portion.

6. The leg-rest assembly of claim 5, wherein the first end of each of the first and second mounting brackets is pivotally connected at the second position to the, respective first and second side rails of the seat pan.

7. The leg-rest assembly of claim 5, wherein:

the first cable is spaced apart from and substantially parallel to the second cable; and the first mounting bracket is spaced apart from and substantially parallel to the second mounting bracket.

8. The leg-rest assembly of claim 1, wherein:

the leg-rest portion has a top end and a bottom end separated from and substantially parallel to each other;

a first and second side separated from each other and substantially perpendicular to the top and bottom ends; and a side panel removably connected to each of the first and second sides.

9. The leg-rest assembly of claim 8, wherein each of the side panels has a curved outer edge distal to the leg-rest portion.

10. The leg-rest assembly of claim 8, wherein when the leg rest assembly is in a retracted position, the bottom end is recessed with respect to the top end.

11. A leg-rest assembly for a chair including a reclining seat back and a seat having a seat pan, the leg-rest assembly comprising:

a leg-rest portion including:

a top end including a first pulley and a mounting tube pivotally connected to a front end of the seat pan;

a bottom end including a second pulley; and a guide track extending between the top end and the bottom end;

a foot-rest portion attached with the leg-rest portion and configured to telescope from the bottom end;

a cable extending around the first pulley and the second pulley, the cable including a first portion fixed to the foot-rest portion; and a mounting bracket including a first end pivotally connected to the seat pan intermediate the front end and a rear end, and a second end connected to a second portion of the cable and slidably movable along the guide track.

12. The leg-rest assembly of claim 11 wherein the cable is substantially parallel with the guide track.

13. The leg-rest assembly of claim 11 wherein the foot-rest portion comprises a mount fixed to a bottom side of the foot-rest portion.

14. The leg-rest assembly of claim 13 wherein the first portion of the cable comprises a first end of the cable and a second end of the cable, the first and second ends of the cable being secured to the mount.

15. The leg-rest assembly of claim 11 wherein the guide track is configured substantially perpendicular to the mounting tube.

16. The leg-rest assembly of claim 11 further comprising:

a third pulley connected to the leg-rest portion proximate the top end and spaced apart from the first pulley;

a fourth pulley connected to the leg-rest portion proximate the bottom end and spaced apart from the second pulley;

a second cable extending around the third pulley and the fourth pulley, the second cable including a first portion fixed to the foot-rest portion;

a second guide track spaced away from the first guide track and extending between the top end and the bottom end; and a second mounting bracket including a first end pivotally connected the seat pan intermediate the front and rear ends and a second end connected to a second portion of the second cable and slidably movable along the second guide track.

17. The leg-rest assembly of claim 16 wherein the first cable is substantially parallel to the second cable.

18. The leg-rest assembly of claim 11 wherein the leg-rest portion further comprises:

a first side and a second side, the first and second sides being separated from each other and substantially perpendicular to the top and bottom ends; and a side panel removably connected to each of the first and second sides.

19. The leg-rest assembly of claim 18, wherein each of the side panels includes a curved outer edge distal the top end.

* * * * *